US005906237A

United States Patent [19]

Aikawa

[11] Patent Number: 5,906,237

[45] Date of Patent: May 25, 1999

[54] HEAT EXCHANGER HAVING A PLURALITY OF HEAT-EXCHANGING UNITS

[75] Inventor: Yasukazu Aikawa, Nagoya, Japan

[73] Assignee: Denso Corporation, Kariya, Japan

[21] Appl. No.: 09/084,704

[22] Filed: May 26, 1998

[30] Foreign Application Priority Data

May 26, 1997 [JP] Japan ..... 9-135433

[51] Int. Cl.[6] ..... F28D 1/02

[52] U.S. Cl. ..... 165/153; 165/174; 165/175

[58] Field of Search ..... 165/153, 167, 165/176, 175, 174

[56] References Cited

U.S. PATENT DOCUMENTS

| | | | |
|---|---|---|---|
| 1,926,004 | 9/1933 | Haskins et al. | 165/174 |
| 4,116,268 | 9/1978 | Krüger | 165/174 X |
| 4,303,124 | 12/1981 | Hessari | 165/174 X |
| 4,330,034 | 5/1982 | Lang et al. | 165/174 X |
| 5,186,249 | 2/1993 | Bhatti et al. | 165/174 |
| 5,400,853 | 3/1995 | Wolters | 165/176 X |
| 5,575,329 | 11/1996 | So et al. | 165/176 X |
| 5,701,760 | 12/1997 | Torigoe et al. . | |
| 5,752,566 | 5/1998 | Liu et al. | 165/175 X |

FOREIGN PATENT DOCUMENTS

| | | | |
|---|---|---|---|
| 403247992 | 11/1991 | Japan | 165/174 |
| 404174296 | 6/1992 | Japan | 165/174 |
| 404174297 | 6/1992 | Japan | 165/174 |

*Primary Examiner*—Ira S. Lazarus
*Assistant Examiner*—Christopher Atkinson
*Attorney, Agent, or Firm*—Harness, Dickey & Pierce, PLC

[57] ABSTRACT

In a refrigerant evaporator constructed by a plurality of heat-exchanging units, a bypass passage to bypass at least one of the plurality of heat-exchanging units is provided, and the refrigerant passage area thereof is set to be less than that of a refrigerant passage in the heat exchanging units. Thus, a part of the liquid refrigerant can bypass the heat-exchanging units, and the liquid refrigerant quickly flows out of the evaporator, thereby shortening the time for returning the liquid refrigerant to the compressor right after the refrigerating cycle starts.

6 Claims, 6 Drawing Sheets

HEAT EXCHANGER HAVING A PLURALITY OF HEAT-EXCHANGING UNITS

CROSS REFERENCE TO RELATED APPLICATION

This application is based on and incorporates herein by reference Japanese Patent Application No. Hei. 9-135433 filed on May 26, 1997.

BACKGROUND OF THE INVENTION

1. Field of the Invention:

The present invention relates to a refrigerant evaporator which is constructed by connecting a plurality of heat-exchanging units provided with refrigerant passages therein.

2. Description of Related Art:

A refrigerant evaporator 1 having a refrigerant flow route shown in FIG. 6 is disclosed in U.S. patent application Ser. No. 08/730990. In the evaporator 1, an inlet side heat-exchanging portion X is disposed at an air downstream side, and an outlet side heat-exchanging portion Y is disposed at an air upstream side. An arrow A represents an air-flow direction. The inlet side heat-exchanging portion X communicates with an upper side inlet tank portion 43 and a lower side inlet tank portion 44. The outlet side heat-exchanging portion Y communicates with an upper side outlet tank portion 47 and a lower side outlet tank portion 48. Heat exchange between the refrigerant flowing in the evaporator 1 and the air flowing outside the evaporator 1 is carried out in the heat-exchanging portions X and Y. The lower side inlet tank portion 44 is separated into a first inlet tank portion "a" and a second inlet tank portion "b" by first partition member 51. The upper side outlet tank portion 47 is separated into a first outlet tank portion "c" and a second outlet tank portion "d" by second partition member 52.

In the evaporator 1, as shown in FIG. 7, a tube 2 through which the refrigerant flows is constructed by connecting a pair of metal plates 4 shown in FIG. 3 to face each other. An inside of the tube 2 is partitioned into an air upstream side refrigerant passage 2*a* and an air downstream side refrigerant passage 2*b* by a center rib 49.

The refrigerant flows inside the evaporator 1 in accordance with the following route which is shown by bold arrows in FIG. 6; "refrigerant inlet pipe 8*a*→refrigerant passage 15→first inlet tank portion "a"→air downstream side refrigerant passages 2*b*→upper side inlet tank portion 43→air downstream side refrigerant passages 2*b*→second inlet tank portion "b"→refrigerant passage 13→first outlet tank portion "c"→air upstream side refrigerant passages 2*a*→lower side outlet tank portion 48→air upstream side refrigerant passages 2*a*→second outlet tank portion "d"→refrigerant passage 14→refrigerant outlet pipe 8*b*". As shown in FIG. 6, the refrigerant inlet pipe 8*a* and the refrigerant outlet pipe 8*b* are connected to the right side of the evaporator 1. The refrigerant passages 14 and 15 are formed at the right side of the evaporator 1. The refrigerant passage 13 is formed at the left side of the evaporator 1.

In the inlet side heat-exchanging portion X and the outlet side heat-exchanging portion Y, the refrigerant flows in the same direction. That is, in FIG. 6, at the right side of the partition members 51 and 52 in the heat exchanging portions X and Y, the refrigerant flows upwardly, while at the left side of the partition plates 51 and 52, the refrigerant flows downwardly.

Further, as shown in FIG. 6, the air downstream side heat-exchanging portion X includes first and second heat-exchanging units ①, ② having refrigerant passages. In a similar way, the air upstream side heat-exchanging portion Y includes third and fourth heat-exchanging units ③, ④. The refrigerant flows in the heat-exchanging portions X, Y while meandering. Thereby, the evaporation amount of the refrigerant is increased and the cooling ability of the evaporator is improved.

However, when a refrigerating cycle with the above-described evaporator starts under the condition that the cooling load is low, such as in winter, the liquid refrigerant may not return to a compressor enough to lubricate the compressor sufficiently right after the start of the refrigerating cycle.

That is, under the condition that the cooling load is low for example, in winter, the opening degree of an expansion valve (pressure reducing means) becomes small even right after the refrigerating cycle starts, thereby decreasing the refrigerant flow amount. Further, because of the improved cooling ability in the heat-exchanging portions X, Y, most of the liquid refrigerant evaporates and becomes the gas phase refrigerant before reaching the refrigerant outlet pipe 8*b*.

Therefore, when the refrigerating cycle starts under the above-described condition, it takes a long period until the liquid refrigerant is stored in the evaporator. Thus, after the refrigerating cycle starts, it takes a long period until the liquid refrigerant returns to the compressor. Thereby, lack of the lubricant oil which returns to the compressor with the liquid refrigerant occurs.

Especially, in the refrigerating cycle to which a variable capacity type compressor is applied, when the compressor is controlled to operate a small capacity operation for reducing a starting shock thereof, the refrigerant flow amount is further decreased under the condition that the cooling load is low in winter. Thus, the compressor is less lubricated than that in the above-described normal type refrigerating cycle.

SUMMARY OF THE INVENTION

The present invention is made in light of the foregoing problem, and it is an object of the present invention to provide a refrigerant evaporator which is reduced in lack of lubrication in a compressor by shortening the time for returning the liquid refrigerant to the compressor right after the cycle starts under the condition that the cooling load is low in winter.

According to the present invention, a bypass passage to bypass at least one of the plurality of heat-exchanging units is provided, and the refrigerant passage area thereof is set to be less than that of a refrigerant passage in the heat exchanging units. Thus, a part of the liquid refrigerant can bypass the heat-exchanging units. As the liquid refrigerant bypassing the heat-exchanging units flows while being little evaporated in the evaporator, an amount of the refrigerant evaporation in the evaporator can be reduced.

Accordingly, the liquid refrigerant quickly flows out of the evaporator, thereby shortening the time for returning the liquid refrigerant to the compressor right after the refrigerating cycle starts. As a result, lubricant oil included in the liquid refrigerant returns to the compressor quickly, thereby improving the lubrication in the compressor. This advantage is particularly attained in a refrigerating cycle to which a variable capacity type compressor is applied.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Figure 1:
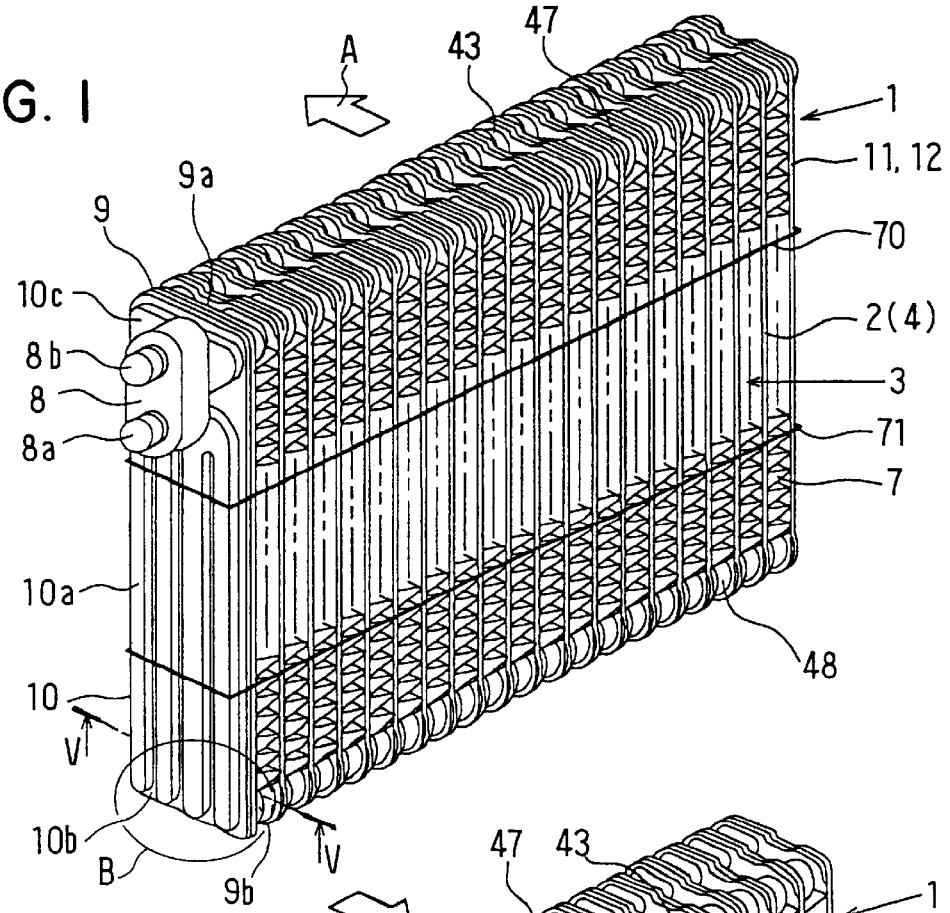
FIG. 1 is a perspective view showing the front side of an evaporator according to the present embodiment.

Referring to the drawings, preferred embodiments of the present invention will be described.

An evaporator 1 is disposed in the cooling unit casing (not illustrated) of a vehicle air conditioning apparatus. In FIG. 1, a pipe joint 8 is provided at one end (the left end in FIG. 1 or the right end in FIG. 2) of the evaporator 1. An outlet pipe of a temperature responsive expansion valve 60 (see FIG. 10) is connected to the refrigerant inlet pipe 8*a* of the pipe joint 8. A low temperature and low pressure gas-liquid phase refrigerant having been pressure-reduced and expanded by the expansion valve 60 flows into the refrigerant inlet pipe 8*a*.

Figure 2:
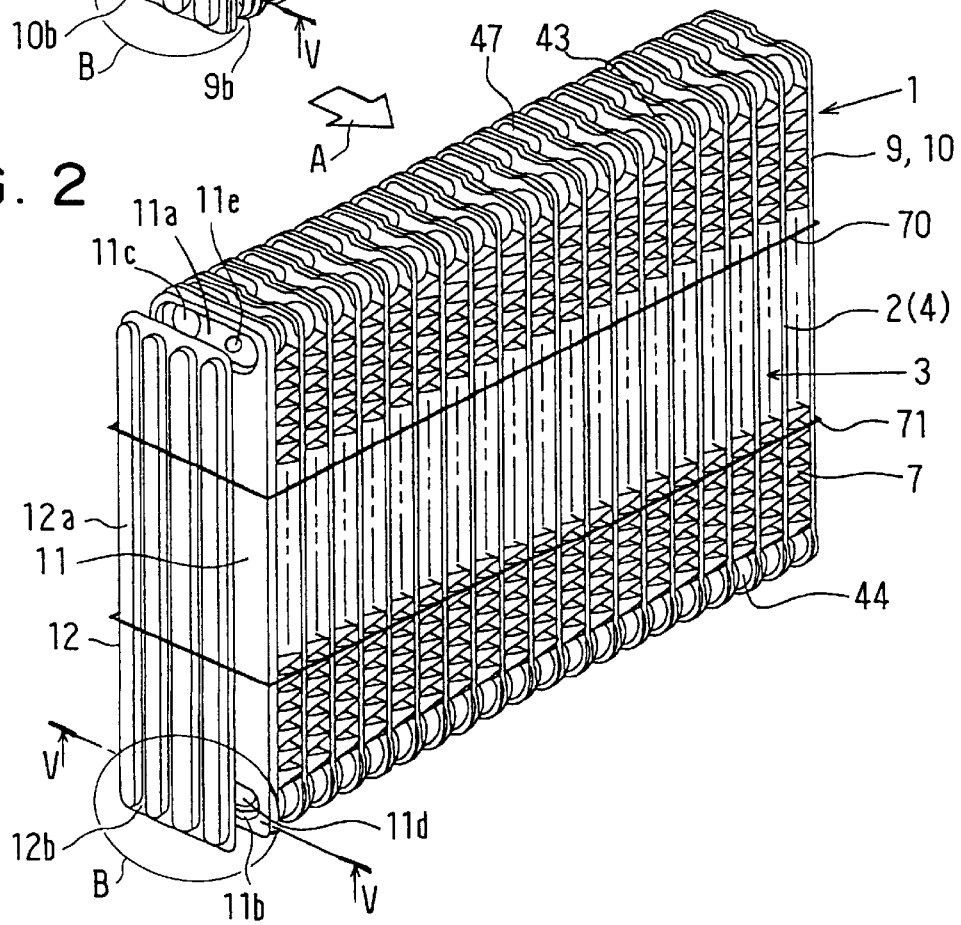
FIG. 2 is a perspective view showing the back side of the evaporator according to the present embodiment.

The evaporator 1 includes a heat-exchanging portion 3. The heat-exchanging portion 3 includes a plurality of tubes 2 arranged in parallel and carries out a heat exchange between the refrigerant flowing inside the tube 2 and an air flowing outside the tube 2. In FIGS. 1 and 2, an arrow A denotes an air-flow direction.

Figure 3:
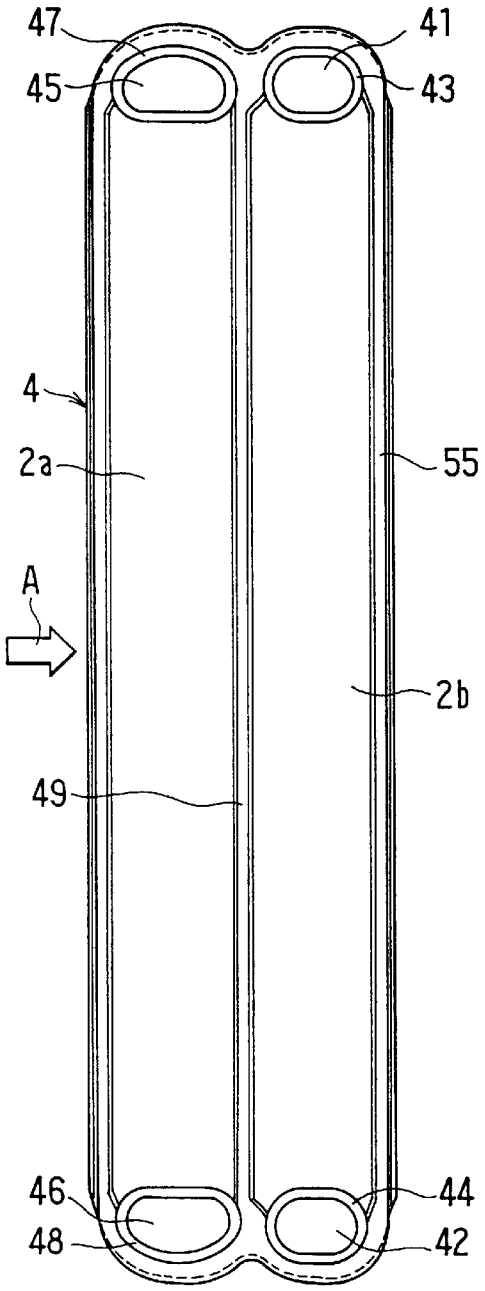
FIG. 3 RELATED ART
FIG. 3 is a plan view of a metal plate for forming a related art tube.
Figure 7:
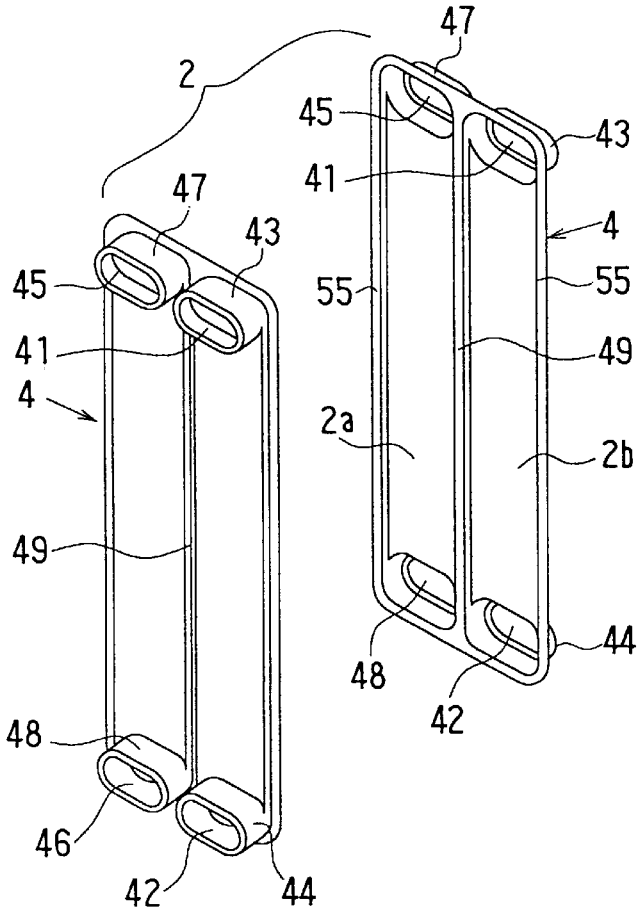
FIG. 7 RELATED ART
FIG. 7 is a perspective dealing view showing a related art tube.

The tube 2 is, as shown in FIG. 7, formed by a pair of metal plates 4 facing each other. As the metal plate 4, brazing sheet (thickness: about 0.4–0.6 mm) obtained by cladding an aluminum brazing material (for example A4000) on the two surfaces of an aluminum core material (for example A3000) is used, and the brazing sheet is formed into a shape as shown in FIG. 3. The heat-exchanging portion 3 is constructed by laminating a large number of tubes 2 and joining them by brazing. Inside the tube 2, an air upstream side refrigerant passage 2*a* and an air downstream side refrigerant passage 2*b* are formed in parallel to the longitudinal direction of the metal plate 4.

The metal plate 4 in FIG. 3 is a thin plate for forming the tube 2. An upper side inlet tank portion 43 and a lower side inlet tank portion 44 having a communication hole 41, 42 respectively are formed at both upper and lower ends of the metal plate 4. In a similar way, an upper side outlet tank portion 47 and a lower side outlet tank portion 48 having a communication hole 45, 46 respectively are formed. The communication holes 41, 42 communicate the air downstream side refrigerant passages 2*b* of each metal plate 4 with each other, and the communication holes 45 and 46 communicate the air upstream side refrigerant passages 2*a* of each plate 4 with each other. These tank portions 43, 44, 47, 48 are formed into a shape of an ellipse columnar protrusion portions protruding toward the outside of the metal plate 4. The cross sectional surface area of the inlet tank portions 43, 44 are set to be smaller than those of the outlet tank portions 47, 48.

A center rib 49 is formed in the metal plate 4 for partitioning the inside thereof into the air upstream side refrigerant passage 2*a* and the air downstream side air passage 2*b*. A width dimension of the air upstream side refrigerant passage 2*a* is the same as that of the air downstream side refrigerant passage 2*b*.

An outer periphery rib 55 is press formed at the outer periphery of each metal plate 4 by the same height. The pair of metal plates 4 are joined to form the tube 2 by contacting the outer periphery ribs 55 with each other.

In the heat-exchanging portion 3, a corrugated fin 7 is provided between the adjacent tubes 2. The fin 7 increases the heat transferring surface area in the air flowing side of the heat-exchanging portion 3. The fin 7 is made of an aluminum-bare (for example A3003) not being clad with an aluminum brazing material and formed into a wave shape.

At one end (the left end in FIG. 1 or the right end in FIG. 2) of the heat-exchanging portion 3, a side plate 9 and an end plate 10 are provided. The end plate 10 is connected to the side plate 9. At the other end (the right end in FIG. 1 or the left end in FIG. 2) of the heat exchanging-portion 3, a side plate 11 and an end plate 12 are provided. The end plate 12 is connected to the side plate 11. These side and end plates 9, 10, 11, 12 are made of the same brazing sheet as the metal plate 4. Here, the thickness of these plates 9, 10, 11, 12 are set to be thicker than that of the metal plate 4, for example about 1.0–1.6 mm, for providing a sufficient strength.

Figure 4:
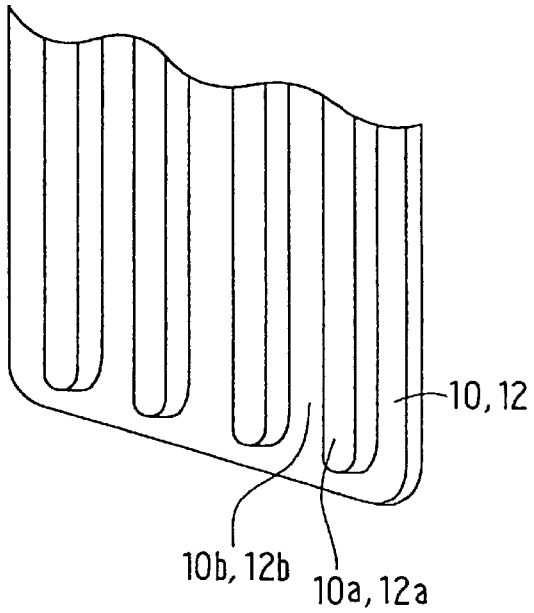
FIG. 4 is an enlarged view of the area B in FIGS. 1 and 2.
Figure 5:
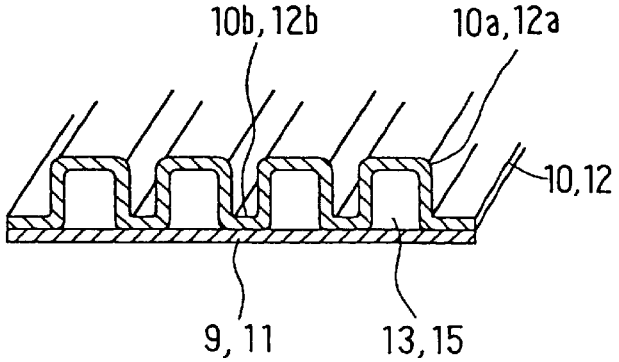
FIG. 5 is a cross sectional view taken along a line V—V in FIGS. 1 and 2.

The end plates 10, 12 are provided with a plurality of protrusion portions 10*a*, 12*a* protruding toward the outside of the heat-exchanging portion 3 respectively, as shown in FIGS. 4, 5. The protrusion portions 10*a*, 12*a* are formed into a rectangular shape in cross section, and are arranged in parallel to the longitudinal direction of the end plates 10, 12. Refrigerant passages 15, 13 (fluid passage) are provided between the protrusion portions 10*a*, 12*a* and the flat surfaces of the side plates 9, 11 respectively.

Between the protrusion portions 10*a*, 12*a* adjacent to each other, connecting portions 10*b*, 12*b* elongating in the longitudinal direction of the end plates 10, 12 are formed. The connecting portions 10*b*, 12*b* are connected to the flat surfaces of the side plates 9, 11.

At the upper and lower ends of the side plate 9, an upper side tank portion 9*a* and a lower side tank portion 9*b* are formed respectively. These tank portions 9*a* and 9*b* are formed as oval-shaped concave portions elongating in the width direction of the side plate 9. In each upper side tank portion 9*a* and the lower side tank portion 9*b*, a communication hole 9*c* and a communication hole 9*d* are formed.

At the upper and lower ends of the side plate 11, also, an upper side tank portion 11*a* and a lower side tank portion 11*b* are formed respectively. These tank portions 11*a* and 11*b* are formed as oval-shaped concave portions elongating in the width direction of the side plate 11. In each upper side tank portion 11*a* and the lower side tank portion 11*b*, a communication hole 11*c* and a communication hole 11*d* are formed.

The lower end of the refrigerant passage 13 communicates with the communication hole 42 in the lower side inlet tank portion 44 through the communication hole 11*d* of the lower side tank portion 11*b*. The upper end of the refrigerant passage 13 communicates with the communication hole 45 in the upper side outlet tank portion 47 through the communication hole 11*c* of the upper side tank portion 11*a*.

Figure 8A:
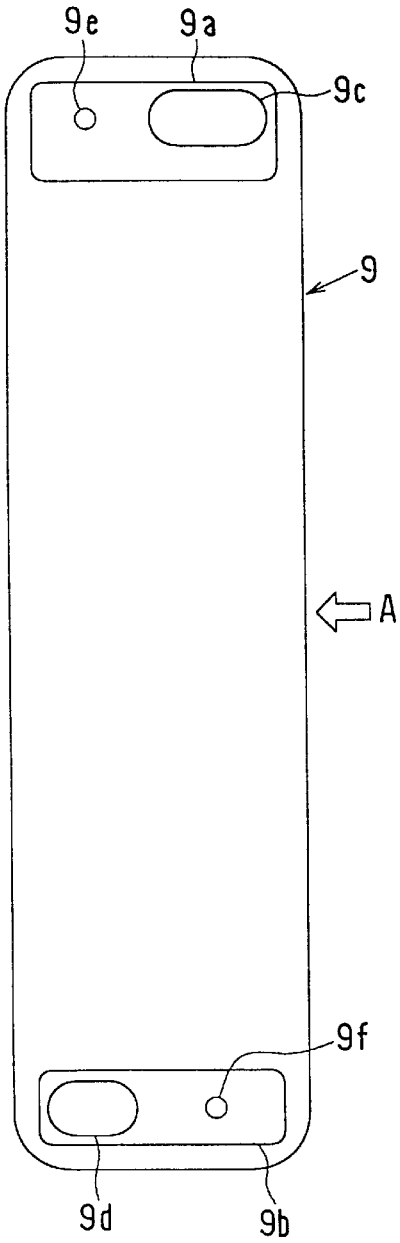
FIG. 8A is a front view showing a side plate according to the present embodiment.
Figure 8B:
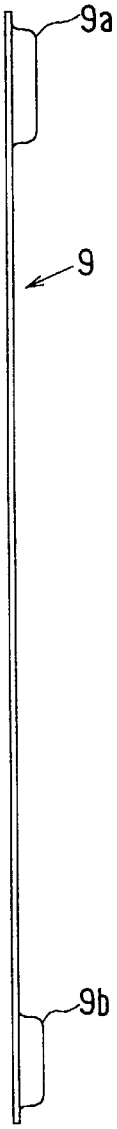
FIG. 8B is a side view showing a side plate according to the present embodiment.

As shown in FIG. 8, bypass holes 9*e*, 9*f* are formed next to the communication holes 9*c*, 9*d* of both tank portions 9*a*, 9*b* respectively.

In the end plate 10, as shown in FIG. 1, the protrusion portion 10*a* is formed below the pipe joint 8, and a stage portion 10*c* is formed above the protrusion portion 10*a*. The stage portion 10*c* is formed as an oval-shaped convex portion.

Between the inside of the stage portion 10*c* and the side plate 9, a refrigerant passage 14 (see FIG. 6) is provided. The protrusion portion 10*a* and the stage portion 10*c* are arranged such that the refrigerant in the refrigerant passage 15 and the refrigerant in the refrigerant passage 14 do not communicate with each other.

The refrigerant passage 14 communicates with the communication hole 45 in the upper side outlet tank portion 47 through the communication hole 9*c* in the upper side outlet tank portion 9*a* of the side plate 9, and with the refrigerant outlet pipe 8*b* of the pipe joint 8. The upper end of the refrigerant passage 15 communicates with the refrigerant inlet pipe 8*a* of the pipe joint 8. The lower end of the refrigerant passage 15 communicates with the communication hole 42 in the lower side inlet tank portion 44 through the communication hole 9*d* in the inlet tank portion 9*b* of the side plate 9.

The pipe joint 8 is made of an aluminum bare (for example A6000), and the refrigerant inlet pipe 8*a* and the refrigerant outlet pipe 8*b* are integrated with the pipe joint 8. Each end portion of the refrigerant inlet pipe 8*a* and the refrigerant outlet pipe 8*b* is inserted into the hole (not illustrated) of the end plate 10 and fixed to this by brazing. The outlet side refrigerant pipe of the expansion valve 60 is connected to the refrigerant inlet pipe 8*a*, and a compressor suction pipe which introduces the gas phase refrigerant evaporated by the evaporator 1 into the compressor 61 is connected to the refrigerant outlet pipe 8*b*.

Figure 6:
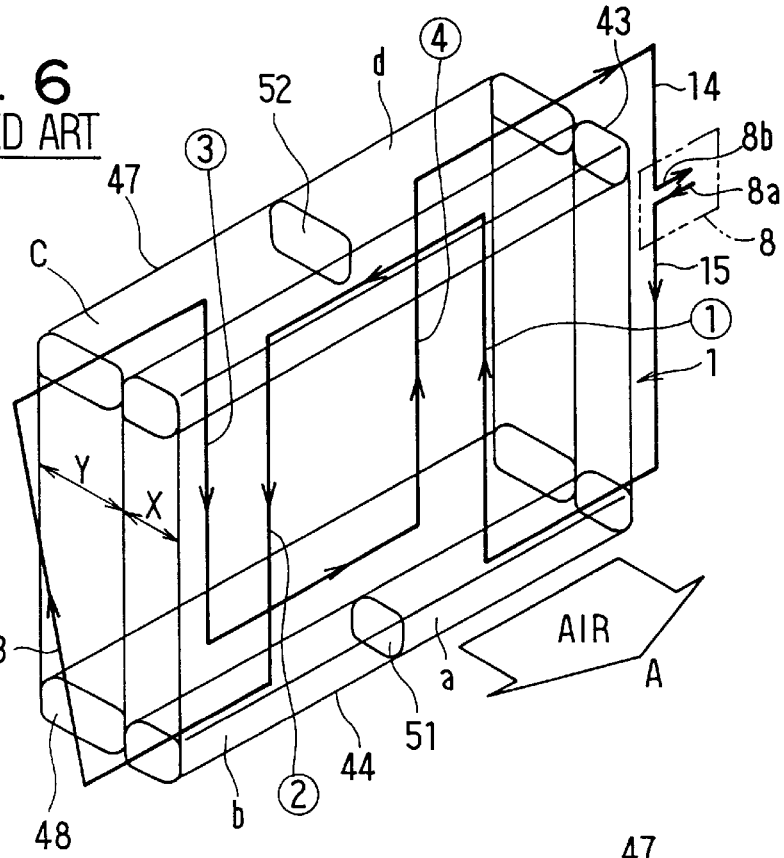
FIG. 6 RELATED ART
FIG. 6 is a schematic perspective view showing a refrigerant flow route in a related art evaporator.
Figure 9:
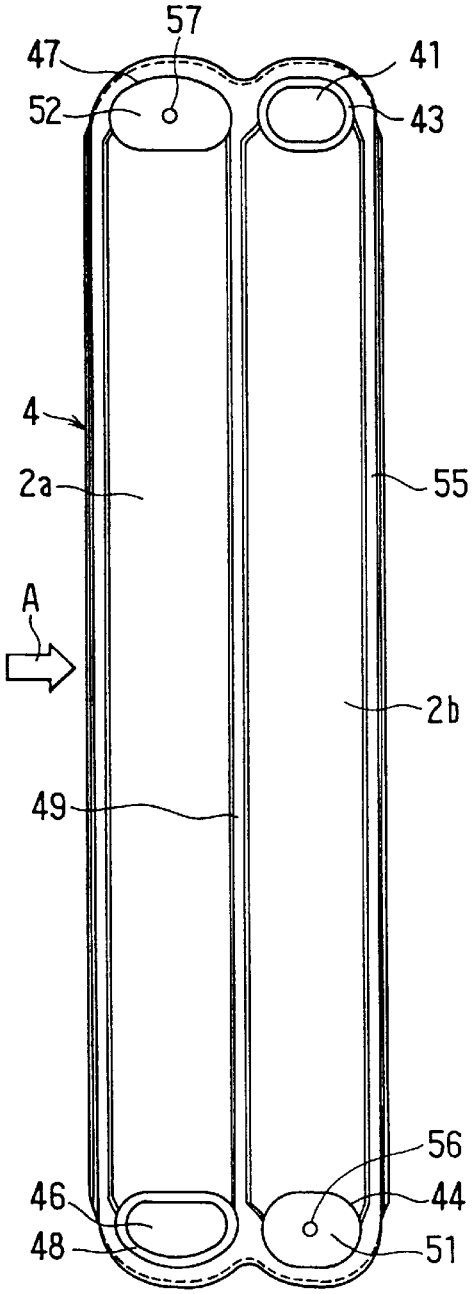
FIG. 9 is a front view showing a metal plate having partition members and bypass holes.

FIG. 6 is a schematic perspective view of the refrigerant flow route in the evaporator 1, which is corresponding to the view of FIG. 2. A first partition member 51 is disposed at the predetermined position inside the lower side inlet tank portion 44, and a second partition member 52 is disposed at the predetermined position inside the upper side outlet tank portion 47. As shown in FIG. 9, the first partition member 51 is formed by closing the communication hole 42 in the lower side inlet tank portion 44 of the metal plate 4. In a similar way, the second partition member 52 is formed by closing the communication hole 45 in the upper outlet side tank portion 47 of the metal plate 4.

In the present embodiment, bypass holes 56, 57 are formed in the partition members 51, 52 respectively.

By disposing the first partition member 51, the lower side inlet tank portion 44 is separated into a first inlet tank portion "a" and a second inlet tank portion "b". By disposing the second partition member 52, the upper side outlet tank portion 47 is separated into a first outlet tank portion "c" and a second outlet tank portion "d".

According to the above-described structure, the refrigerant flows inside the evaporator 1 in accordance with the following route, "refrigerant inlet pipe 8*a*→refrigerant passage 15→first inlet tank portion "a"→air downstream side refrigerant passages 2*b*→upper side inlet tank portion 43→air downstream side refrigerant passages 2*b*→second inlet tank portion "b"→passage 13→first outlet tank portion "c"→air upstream side refrigerant passages 2*a*→lower side outlet tank portion 48→air upstream side refrigerant passages 2*a*→second outlet tank portion "d"→refrigerant passage 14→refrigerant outlet pipe 8*b*".

In this way, the heat-exchanging portion 3 includes a refrigerant inlet side heat-exchanging portion X being disposed at the air downstream side and a refrigerant outlet side heatexchanging portion Y being disposed at the air upstream side. The refrigerant inlet side heat-exchanging portion X includes first and second heat-exchanging units ①, ②. The refrigerant outlet side heat-exchanging portion Y includes third and fourth heat-exchanging units ③, ④.

The assembling process of the evaporator 1 according to the present embodiment will be explained.

At first, the metal plates 4, corrugated fin 7, side plates 9, 11, and the end plates 10, 12 are stacked, and after that, the pipe joint 8 is connected to the end plate 10. In this way, a temporarily assembly of a predetermined structure of the evaporator 1 showed in FIGS. 1, 2 is provided.

Next, the temporarily assembled condition of the evaporator 1 is held by binding the temporarily assembled structure of the evaporator 1 from the outsides of the end plates 10, 12 tightly with wires 70, 71.

Finally, the temporarily assembled structure of the evaporator 1 is carried into a brazing furnace and heated to the melting point of the aluminum brazing material, then each connecting part of the temporarily assembled structure of the evaporator 1 is fixed by brazing.

Here, according to the present embodiment, for shortening a time for returning the liquid refrigerant to the compressor 61 just after a refrigerating cycle starts under the condition that the cooling load is low as in winter, the following featured structure is adopted.

Figure 10:
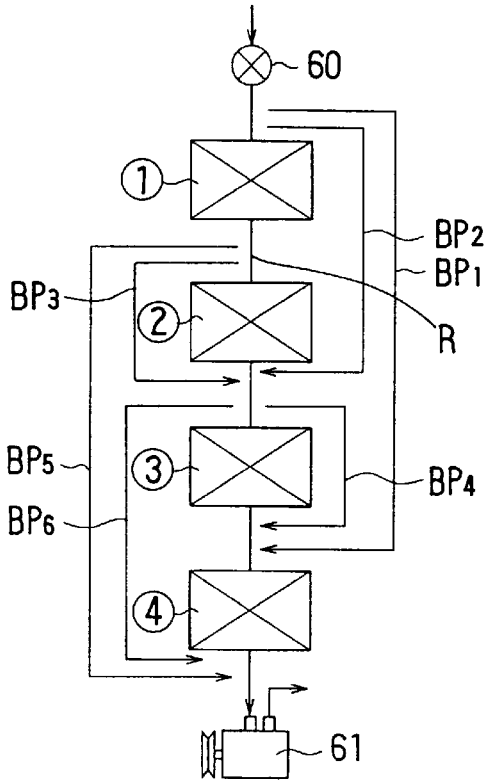
FIG. 10 is a schematic view showing a refrigerant flow route according to the present embodiment.

FIG. 10 is a schematic view simplifying the refrigerant flowing route in FIG. 6. A main refrigerant route R (straight line extending vertically in FIG. 10) is constructed by connecting the refrigerant passages 2*a*, 2*b* in the heat-exchanging units ①–④. The refrigerant flows in the main refrigerant route while being evaporated.

References $BP_1$–$BP_6$ denote six bypass passages, i.e., first through sixth bypass passages. The first bypass passage $BP_1$ bypasses the first, second and third heat-exchanging units ①, ②, ③. The second bypass passage $BP_2$ bypasses the first and second heat-exchanging units ①, ②. The third bypass passage $BP_3$ bypasses the second heat-exchanging unit ②. The fourth bypass passage $BP_4$ bypasses the first, second and third heat-exchanging units ③. The fifth bypass passage $BP_5$ bypasses the second, third and fourth heat-exchanging units ②, ③, ④. The sixth bypass passage bypasses the third and forth heat-exchanging units ③, ④.

Here, the temperature responsive expansion valve (pressure reducing means) 60 adjusts the flow amount of the refrigerant flowing into the evaporator 1 so that the superheat of the refrigerant at the outlet of the evaporator 1 becomes a predetermined value. The compressor 61 suctions and compresses the refrigerant having flowed through the evaporator 1.

Figure 11:
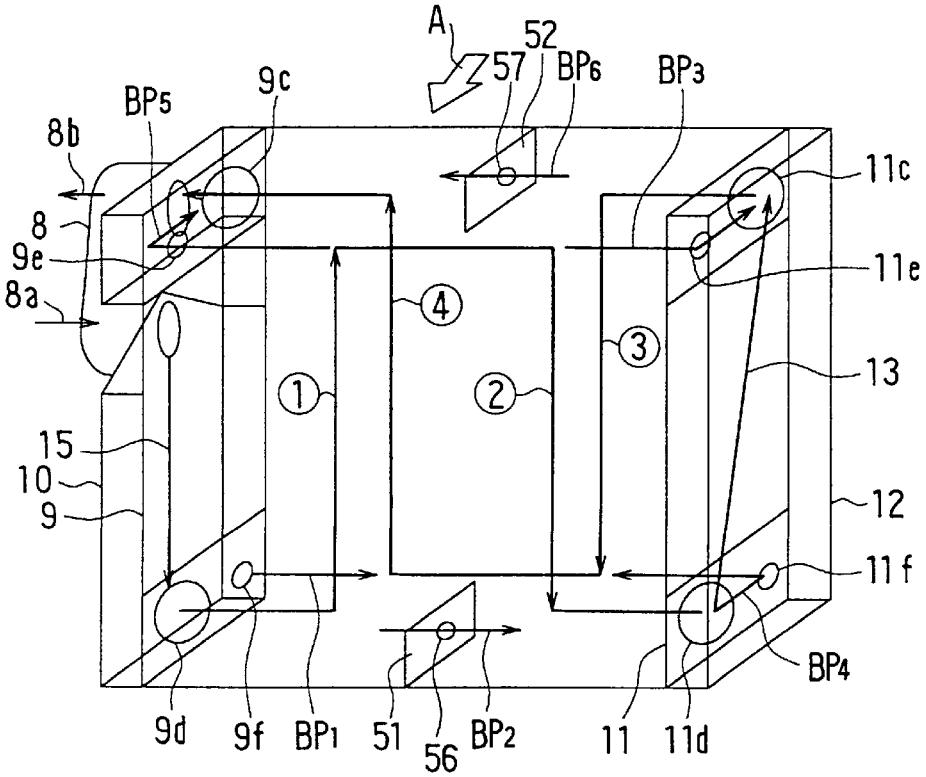
FIG. 11 is a schematic perspective view showing a refrigerant flow route in the evaporator according to the present embodiment.

FIG. 11 shows the refrigerant flowing route shown in FIG. 6 and the bypass passages $BP_1$–$BP_6$. The first bypass passage $BP_1$ bypasses the refrigerant passages 2*a*, 2*b* in the first through third heat-exchanging units ①, ②, ③, and is formed by opening the bypass hole 9*f* in the lower side inlet tank portion 9*b* of the side plate 9.

A part of the refrigerant introduced into the lower side tank portion 9*b* (see FIGS. 1, 8) through the refrigerant inlet pipe 8*a* and the refrigerant passage 15 flows directly into the lower side outlet tank portion 48 through the bypass hole 9*f*. That is, this bypassed refrigerant flows through only the fourth heat-exchanging unit ④ and into the communication hole 9*c* of the upper tank portion 9*a*.

The second bypass passage $BP_2$ bypasses the air downstream side refrigerant passages 2*b* in the heat-exchanging units ①, ②, and is formed by opening the bypass hole 56 in the first partition member 51 of the metal plate 4.

A part of the refrigerant introduced into the lower side inlet tank portion 44 through the communication hole 9*d* of the lower side tank portion 9*b* flows directly into the communication hole lid of the lower tank portion 11*b* through the bypass hole 56. That is, this bypassed refrigerant flows through only the third and fourth heat-exchanging units ③, ④ and into the communication hole 9*c* of the upper tank portion 9*a*.

The third bypass passage $BP_3$ bypasses the air downstream side refrigerant passages 2*b* in the second heat-exchanging unit ②, and is formed by opening the bypass hole 11*e* (see FIGS. 2, 11) in the side plate 11 next to the communication hole 11*c* of the upper tank portion 11*a*.

A part of the refrigerant introduced into the lower side inlet tank portion 44 through the air downstream side refrigerant passages 2*b* in the first heat-exchanging unit ① flows directly into the communication hole 11*c* of the upper side tank portion 11*a* through the bypass hole 11*e*.

The fourth bypass passage $BP_4$ bypasses the air upstream side refrigerant passages 2*a* in the third heat-exchanging units ③, and is formed by opening the bypass hole 11*f* (see FIG. 11) in the side plate 11 next to the communication hole 11*d* of the lower side tank portion 11*b*.

A part of the refrigerant introduced into the lower side tank portion 11*b* through the communication hole 11*d* of the lower side tank portion 11*b* flows directly into the lower side outlet tank portion 48 through the bypass hole 11*f*.

The fifth bypass passage $BP_5$ bypasses the refrigerant passages 2*a*, 2*b* in the second through fourth heat-exchanging units ②, ③, ④, and is formed by opening the bypass hole 9*e* (see FIGS. 8, 11) in the upper tank portion 9*a* of the side plate 9.

A part of the refrigerant introduced into the upper side inlet tank portion 43 through the first heat-exchanging unit ① flows directly into the communication hole 9*c* of the upper tank portion 9*a* through the bypass hole 9*e*. That is, this bypassed refrigerant flows through only the first heat-exchanging unit ① and directly into the communication hole 9*c* of the upper tank portion 9*a*.

The sixth bypass passage $BP_6$ bypasses the air upstream side refrigerant passages 2*a* in the third and fourth heat-exchanging units ③, ④, and is formed by opening the bypass hole 57 in the second partition member 52 of the metal plate 4.

A part of the refrigerant introduced into the upper side outlet tank portion 47 through the communication hole 11*c* in the upper side tank portion 11*a* flows directly into the communication hole 9*c* of the upper side tank portion 9*a* through the bypass hole 57. That is, this bypassed refrigerant flows through only the first and second heat-exchanging unit ①, ② and into the communication hole 9*c* of the upper tank portion 9*a*.

As is understood from the above-described explanation, the refrigerant bypasses at least one of the heat-exchanging units ①–④ by providing at least one of the six bypass passages $BP_1$–$BP_6$. The refrigerant bypassing these heat-exchanging units does not heat exchange in the heat-exchanging units being bypassed, thus flows while being little evaporated.

Accordingly, because the amount of the refrigerant being evaporated in the heat-exchanging units ①–④ is reduced, the liquid refrigerant quickly flows out of the evaporator 1 just after the refrigerating cycle starts. Thus, even when the refrigerant flow amount is low just after the refrigerating cycle starts under the condition that the cooling load is low as in winter, the time for returning the liquid refrigerant to the compressor 61 is shortened. As a result, just after the refrigerating cycle starts, the lubricant oil returns to the compressor appropriately in short time, thereby improving the lubrication in the compressor 61.

However, the refrigerant flowing through the bypass passages $BP_1$–$BP_6$ always bypasses the heat-exchanging units ①–④ even when the cooling load is high. Therefore, the refrigerant passage areas (areas in cross section) of the bypass passages $BP_1$–$BP_6$ need to be set to be sufficiently small in comparison with the refrigerant passages 2*a*, 2*b* in the heat-exchanging units ①–④ for suppressing the reduction of the cooling ability (maximum cooling ability) in the evaporator 1 under the condition that the cooling load is high.

The inventors of the present invention experimented to search and study the relation between the effectiveness of to shortening the time for returning the liquid refrigerant to the compressor 61 and the reduction of the cooling ability in the evaporator 1.

Figure 12:
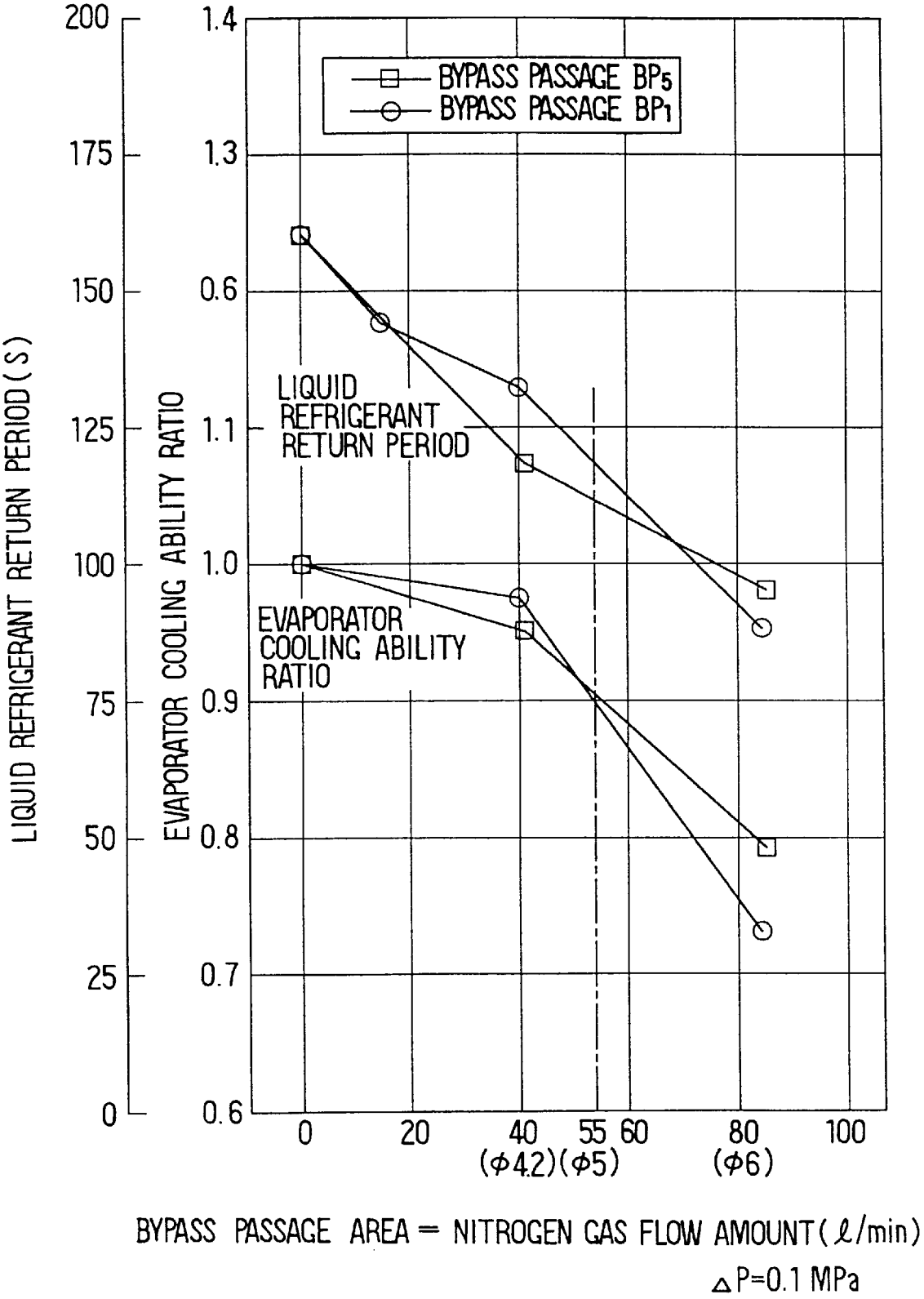
FIG. 12 is a graph showing experimental results of the present embodiment.

FIG. 12 is a graph showing the result of the experiment.

The liquid refrigerant return period (s) while the liquid refrigerant returns to the compressor 61 just after the refrigerating cycle starts is placed on the ordinate axis. The cooling ability ratio in the evaporator 1 is also placed on the ordinate axis. The liquid refrigerant return period is timed by disposing a transparent tube at one part of the refrigerant suction pipe of the compressor 61 pipe, and by watching directly the refrigerant flow in the transparent tube.

The evaporator cooling ability ratio is defined as a cooling ability ratio of the evaporator 1 having the bypass passages $BP_1$–$BP_6$to the conventional evaporator having no bypass passage.

The refrigerant passage areas of the bypass passages $BP_1$–$BP_6$, which are equal to the opening areas of the bypass holes 9*e*, 9*f*, 11*e*, 11*f*, 56, 57, are placed on the abscissa axis. Here, the unit on the abscissa axis is defined as a nitrogen gas flow amount (1/min) when the pressure differences $\Delta P$ between the upstream side and the downstream side of the bypass holes 9*e*, 9*f*, 11*e*, 11*f*, 56, 57 is 0.5 MPa.

In the above-described experiment, the evaporator 1 is provided with the first bypass passage $BP_1$ which bypasses the first through third heat-exchanging units ①, ②, ③, or the fifth bypass passage $BP_5$ which bypasses the second through fourth heat-exchanging units ②, ③, ④.

The experiment was executed under the following experimental condition; air temperature for cooling a condenser of the refrigerating cycle: −2° C., air-flow speed for cooling the condenser of the refrigerating cycle: 2.5 m/s, air temperature supplied to the evaporator 1: 5° C., air-flow amount supplied to the evaporator 1: 200 $m^3$/h, and compressor rotation number: 2100 rpm.

As is shown in FIG. 12, in the conventional evaporator having no bypass passage (nitrogen gas flow amount is zero), it took about 160 s for the liquid refrigerant to return to the compressor. In comparison with this, in the evaporator 1 having the first bypass passage $BP_1$, it took only about 130 s for the liquid refrigerant to return to the compressor. Here, the bypass passage $BP_1$ has an opening area to allow the nitrogen gas to flow by 40 1/min, i.e., opening area corresponding to a circle hole of ø4.2. Further, when the fifth bypass passage $BP_5$ is provided, the liquid refrigerant return period was shortened to about 120 s.

When the first bypass passage $BP_1$ is provided, the evaporator cooling ability ratio is 0.98, and when the fifth bypass passage $BP_5$ is provided, the evaporator cooling ability ratio is 0.96. That is, the evaporator cooling ability ratios are not almost lessened in both cases.

When the evaporator cooling ability ratio is practically allowed to be lessened to 0.9, the liquid refrigerant return period can be shortened to less than 120 s in both cases, by enlarging the refrigerant passages area of the bypass passages $BP_1$, $BP_5$. In this case, the bypass passages $BP_1$, $BP_5$ have an opening area to allow the nitrogen gas to flow by 55 l/min, i.e., opening area corresponding to a circle hole of ø5.0.

The refrigerant flow route in the heat-exchanging portion 3 is not limited to the above-described structure shown in FIGS. 6, 10, 11, and various structures can be applied. For example, the number of the heat-exchanging units ①–④ are not limited to four, two or more heat-exchanging units can be provided.

The evaporator 1 is not limited to the laminating type evaporator constructed by laminating plural metal plates 4 to form the refrigerant passages 2*a*, 2*b*, an evaporator in which oval flat tubes having plural holes or cylindrical tubes are arranged meanderingly can be applied.

In the above-described embodiment, the bypass holes 56, 57 are formed as well as the partition member 51, 52 in the single metal plate 4. Alternatively, the bypass holes 56, 57 may be formed in the metal plate 4 other than in the metal plate 4 where the partition member 51, 52 are formed.

What is claimed is:

1. A refrigerant evaporator for evaporating refrigerant flowing therein so as to cool outside air flowing therethrough, said refrigerant evaporator comprising:

first evaporation passage means for defining a first plurality of evaporation passages through which the refrigerant flows, said first plurality of evaporation passages being formed vertically and arranged substantially in parallel with each other in a direction substantially perpendicular to a flowing direction of said outside air;

a first tank portion connected to each of upper ends and lower ends of said first plurality of evaporation passages, said first tank portion being extended in a direction crossing said first evaporation passages;

second evaporation passage means for defining a second plurality of evaporation passages through which the refrigerant flows, said second plurality of evaporation passages being formed vertically and arranged substantially in parallel with each other in a direction substantially perpendicular to the flowing direction of said outside air, said second plurality of evaporation passages being disposed adjacent to said first plurality of evaporation passages at a downstream side of said first plurality of evaporation passages with respect to the flowing direction of said outside air;

a second tank portion connected to each of upper ends and lower ends of said second plurality of evaporation passages, and said second tank portion being extended in a direction crossing said second plurality of evaporation passages;

communication means for defining a communication passage for communicating between said first plurality of evaporation passages and said second plurality of evaporation passages;

a partition member disposed in said first tank portion and said second tank portion for dividing said first and second evaporation passage means into a plurality of heat exchanging units;

a bypass passage bypassing at least one of said plurality of heat-exchanging units to shorten a time period for introducing a lubricant oil included in the refrigerant from an inlet to an outlet of the evaporator when an increase of a circulation amount of the refrigerant is necessary, wherein;

said bypass passage is formed in said partition member; and a refrigerant passage area of said bypass passage is sufficiently smaller than that of said first and second plurality of evaporation passages.

2. A refrigerant evaporator according to claim 1, wherein the refrigerant passage area of said bypass passage is set to be in such a manner that a cooling capacity deterioration caused by providing said bypass passage is in a range of 10%.

3. A refrigerant evaporator according to claim 1, wherein the refrigerant area of said bypass passage is set to be less than an opening area having a flow rate of 55 liters per minute.

4. A refrigerant evaporator according to claim 1, wherein said first and second evaporation passage means are constructed by connecting a pair of metal plates to face each other, said pair of metal plates are provided with said first and second tank portions having said communication means, and said partition member and said bypass passage are formed in said metal plate.

5. A refrigerant evaporator comprising:

a plurality of heat-exchanging units;

a refrigerant route defined through said plurality of heat exchanging units;

a bypass passage in communication with said refrigerant route at two locations, said by pass passage bypassing at least one but not all of said plurality of heat exchanging units; wherein a cross-sectional area of said bypass passage is smaller than a cross-sectional area of said refrigerant route.

6. A refrigerant evaporator according to claim 5, wherein the refrigerant passage area of said bypass passage is set to be in such a manner that a cooling capacity deterioration caused by providing said bypass passage is in a range of 10%.

* * * * *

UNITED STATES PATENT AND TRADEMARK OFFICE

CERTIFICATE OF CORRECTION

PATENT NO. : 5,906,237

DATED : May 25, 1999

INVENTOR(S) : Yasukazu Aikawa

It is certified that error appears in the above-identified patent and that said Letters Patent is hereby corrected as shown below:

Col. 6, line 7, insert "refrigerant" before --passage--

Col. 6, line 15, "heatexchanging" should be --heat-exchanging--

Col. 6, line 26, "showed" should be --shown--

Col. 6, line 58, "forth" should be --fourth--

Col. 7, line 19, "lid" should be --11d--

Col. 7, line 67, "unit" should be --units--

Col. 8, line 33, delete "to"

Col. 10, line 53, claim 5, "by pass" should be --bypass--

Signed and Sealed this

Eighteenth Day of January, 2000

*Attest:*

Q. TODD DICKINSON

*Attesting Officer*

*Commissioner of Patents and Trademarks*